US006422616B1

(12) United States Patent
Wortmann et al.

(10) Patent No.: US 6,422,616 B1
(45) Date of Patent: Jul. 23, 2002

(54) ADJUSTABLE HOOD LATCH ASSEMBLY

(75) Inventors: Martin Joseph Wortmann, Clarkston; Michael Strole, Davisburg, both of MI (US); Curtis Porter, Huntsville, MO (US)

(73) Assignee: Dura Global Technologies, Inc., Rochester Hill, MI (US)

( * ) Notice: Subject to any disclaimer, the term of this patent is extended or adjusted under 35 U.S.C. 154(b) by 0 days.

(21) Appl. No.: 09/516,748

(22) Filed: Mar. 1, 2000

Related U.S. Application Data

(60) Provisional application No. 60/122,221, filed on Mar. 1, 1999.

(51) Int. Cl.[7] ..... E05C 3/06

(52) U.S. Cl. ..... 292/216; 292/DIG. 14; 292/DIG. 61; 292/214

(58) Field of Search ..... 292/216, 214, 292/117, DIG. 14, DIG. 43, DIG. 61; 362/80

(56) References Cited

U.S. PATENT DOCUMENTS

| | | | | | |
|---|---|---|---|---|---|
| 2,877,038 | A | * | 3/1959 | Kramer | 292/216 |
| 5,288,115 | A | * | 2/1994 | Inoue et al. | 292/201 |
| 6,059,327 | A | * | 5/2000 | Yoshikuwa | 292/216 |
| 6,123,379 | A | * | 9/2000 | Yamada et al. | 296/65.03 |
| 6,149,210 | A | * | 11/2000 | Hunt et al. | 292/216 |

* cited by examiner

*Primary Examiner*—Anthony Knight
*Assistant Examiner*—André L. Jackson

(74) *Attorney, Agent, or Firm*—Porter, Wright, Morris & Arthur LLP

(57) ABSTRACT

A latching mechanism for a closure of a motor vehicle compartment includes a housing forming a vertically extending groove for receiving a striker bar secured to the closure, first and second hollow rivets located on opposite sides of the groove, a striker spring located at the groove for upwardly biasing the striker bar out of the groove, a pawl pivotable about the first hollow rivet and defining a notch, and a ratchet pivotable about the second hollow rivet and defining a protrusion adapted to cooperate with the notch of the pawl to selectively retain the ratchet in a locked position. the ratchet also defines pocket for receiving the striker bar and retaining the striker bar in the groove when the ratchet is in the locked position. Fasteners extend though passageways in the hollow rivets to secure the latching mechanism to the motor vehicle. The striker spring is positioned to directly engage the striker bar when the striker bar is in the groove to bias the striker bar in a direction out of the groove. Adjustment means are preferably provided to adjust the position of the striker spring and therefore the force applied to the striker bar by the striker spring. The latching mechanism preferably further includes a hook pivotable about the first hollow rivet and defining a secondary catch for receiving the striker bar to retain the striker bar in the groove when exiting the ratchet pocket. A paddle is preferably provided to manually pivot the hook and release the striker bar from the secondary catch and the groove. The pawl preferably forms an internal stop which limits rotation of the ratchet when the striker is moving downward to directly transfer over slam forces to the vehicle structure through the hollow rivets and mounting fasteners.

19 Claims, 9 Drawing Sheets

ADJUSTABLE HOOD LATCH ASSEMBLY

RELATED APPLICATIONS

This application claims priority benefit of U.S. Provisional Patent Application No. 60/122,221 filed on March 1, 1999.

FIELD OF THE INVENTION

The present invention generally relates to a latching mechanism and, more particularly, to a latching mechanism for retaining a closure of a motor vehicle compartment in a closed or latched position.

BACKGROUND OF THE INVENTION

Vehicles such as passenger cars, light and heavy duty trucks, tractor trailers, buses, commercial delivery vehicles, among other motorized forms of transportation are conventionally equipped with latched closures for controlling access to one or more compartments of the vehicle. Examples of such closures for compartments include hoods, trunk lids, fuel doors, among others. Examples of latches for hoods are illustrated in copending and commonly assigned U.S. patent application Ser. Nos. 08/985,195 (Porter et al.) and 09/007,421 (Peter Koenig), the disclosures of which are expressly incorporated herein in their entirety by reference. Conventional latches provide adequate access to the vehicle compartment but have several deficiencies. First, the latches typically have a large number of parts and are typically constructed of relatively heavy materials, such as steel, in order to withstand the large forces transmitted through the latch. Second, the latches are typically designed for a hood having a particular size and weight. Third, the latches often fail when the closure is "over slammed", that is, closed with too much. Fourth, vehicle hoods must be designed with crowns to put tension on the latch and prevent rattle during operation of the vehicle. Accordingly, there is a need in the art for a latching mechanism which has reduced weight, can be utilized on a wide range of hood sizes, weights and dimensions, has "over slam" protection, and does not require a crown on the closure to prevent rattle.

SUMMARY OF THE INVENTION

The present invention provides a latch mechanism for a vehicle which overcomes at least some of the above-noted problems of the related art. According to the present invention, a latch mechanism includes, in combination, a housing forming a vertically extending groove for receiving a striker, first and second axles located on opposite sides of the groove, a striker spring located at the groove, a pawl pivotable about the first axle and defining a notch, and a ratchet pivotable about the second axle and defining a protrusion adapted to cooperate with the notch of the pawl to selectively retain the ratchet in a locked position. The ratchet also defines a pocket for receiving the striker and retaining the striker in the groove when the ratchet is in the locked position. According to a preferred embodiment of the present invention, the axles define axially extending passageways therethrough. The passageways enable fasteners to pass therethrough to attach the latching mechanism to the vehicle such that forces are directly transmitted to the structure with out passing through the housing. Therefore, the housing can be constructed of a relatively lightweight material.

According to another aspect of the present invention, means are preferably provided for adjusting the position of the striker spring relative to the groove. By adjusting the position of the striker spring, the force applied to the striker is adjusted so that the latch mechanism can be used with hoods of varying size and/or weight.

According to another aspect of the present invention, a stop is preferably provided which is adapted to limit rotation of the ratchet and downward movement of the striker in the groove, wherein the stop is supported by at least one of the axles. The stop provides over slam protection because the force of the downward moving striker is transmitted directly to the vehicle structure through the axles and not through the housing.

According to yet another aspect of the present invention, the striker spring is preferably positioned at the groove to directly engage the striker, particularly when the ratchet is in the locked position. With the striker spring adapted to directly engage the striker in the locked position, the latching mechanism can be utilized with vehicle closures not having a crown without having rattle problems during operation of the vehicle.

From the foregoing disclosure and the following more detailed description of various preferred embodiments it will be apparent to those skilled in the art that the present invention provides a significant advance in the technology and art of latching mechanisms. Particularly significant in this regard is the potential the invention affords for providing a light weight, high quality, feature-rich, low cost assembly. Additional features and advantages of various preferred embodiments will be better understood in view of the detailed description provided below.

BRIEF DESCRIPTION OF THE DRAWINGS

These and further features of the present invention will be apparent with reference to the following description and drawings, wherein.

Figure 1:
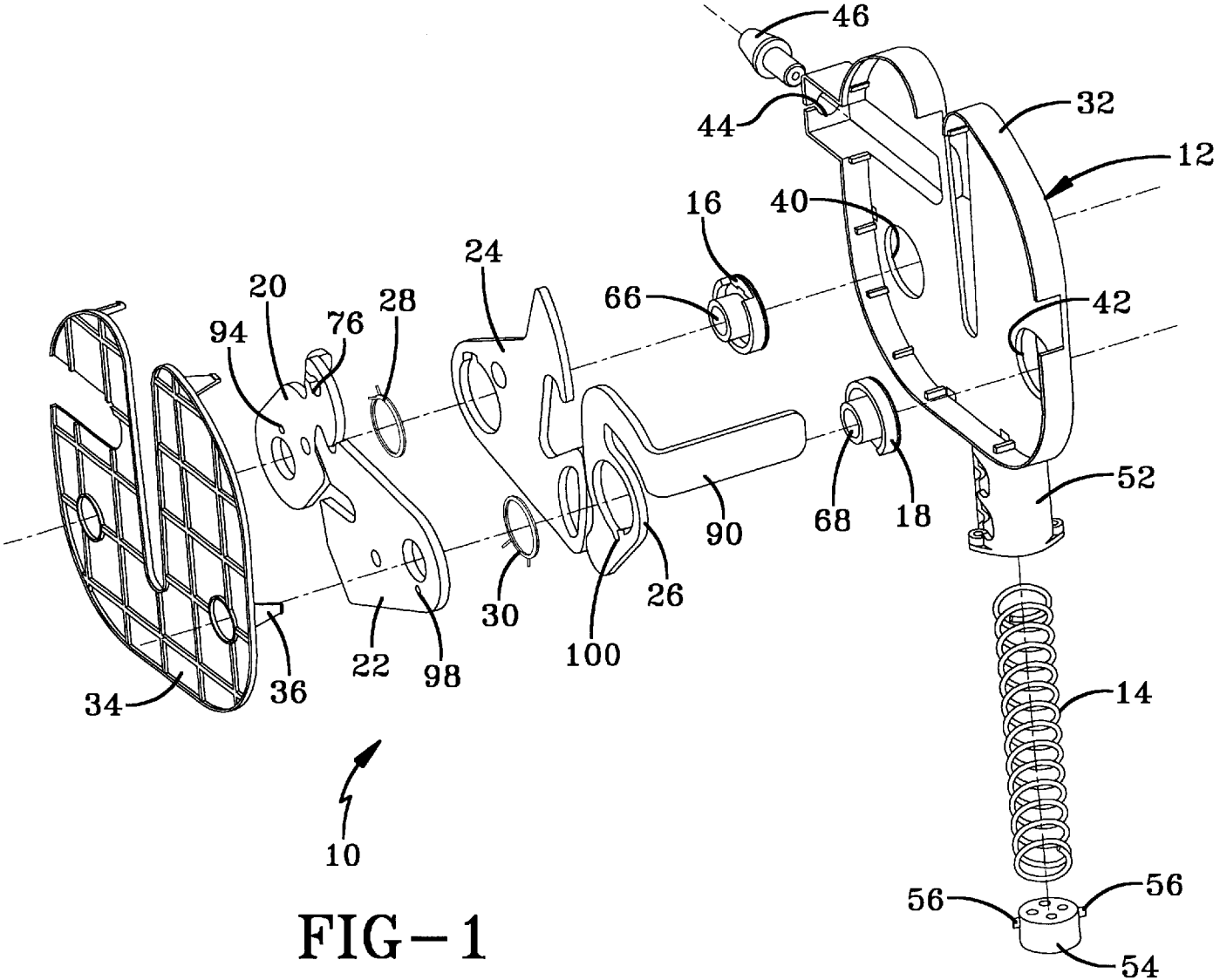
FIG. 1 is an exploded perspective view of an adjustable hood latch mechanism according to the present invention.
Figure 2:
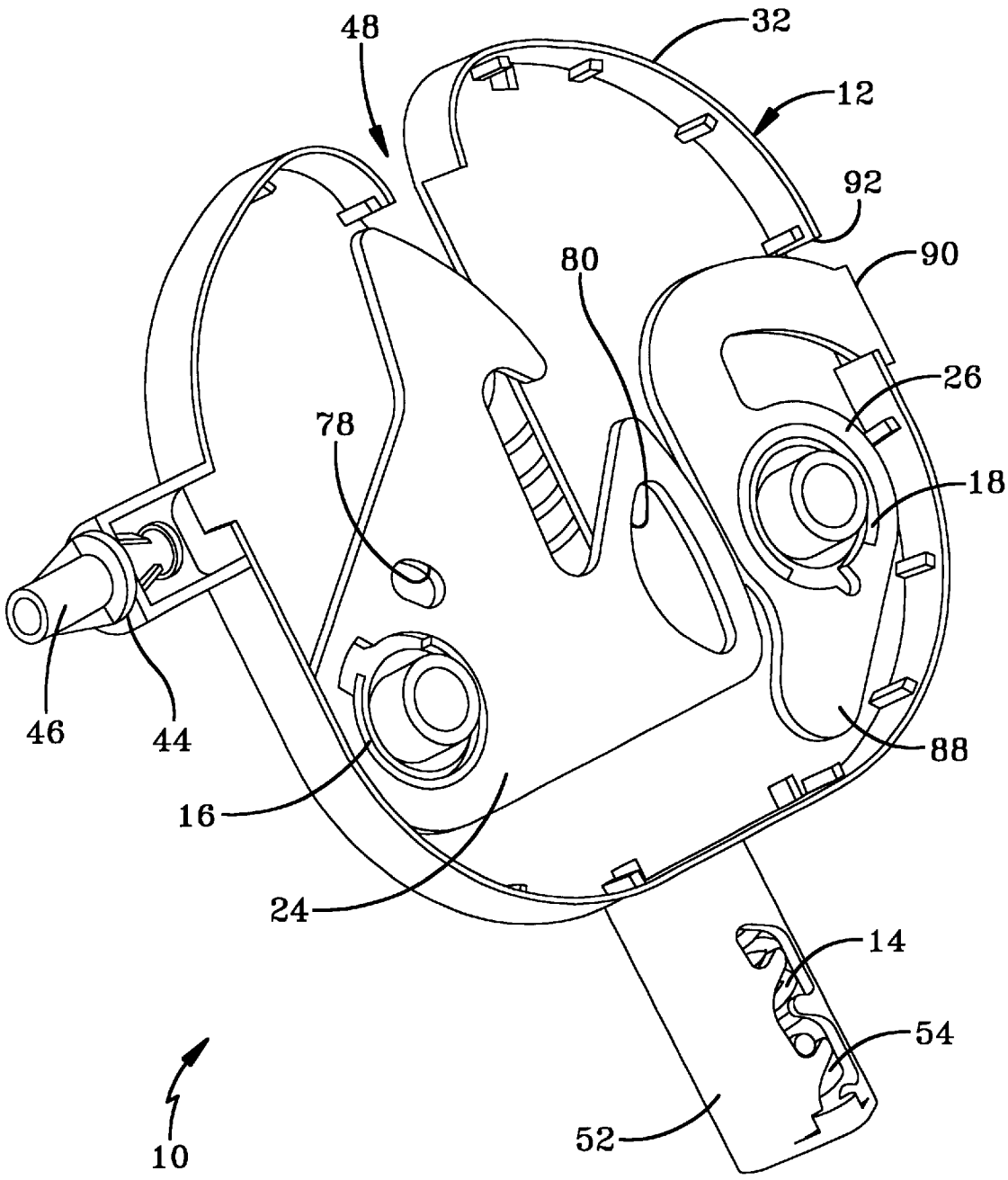
FIG. 2 is a perspective view of the adjustable hood latch mechanism of FIG. 1 in a partially assembled state.
Figure 3:
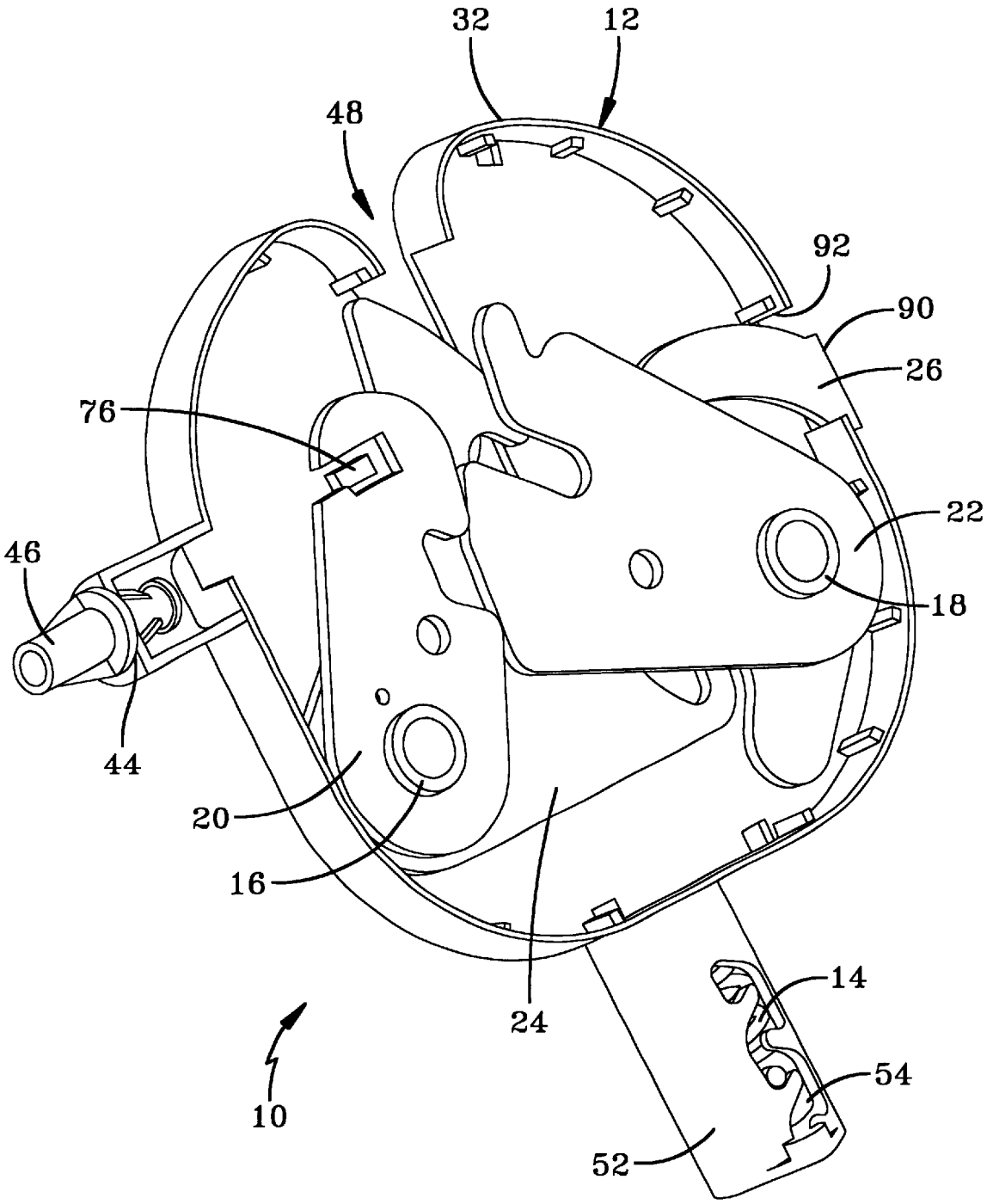
FIG. 3 is a perspective view of the adjustable hood latch mechanism of FIGS. 1 and 2 in a further partially assembled state.
Figure 4:
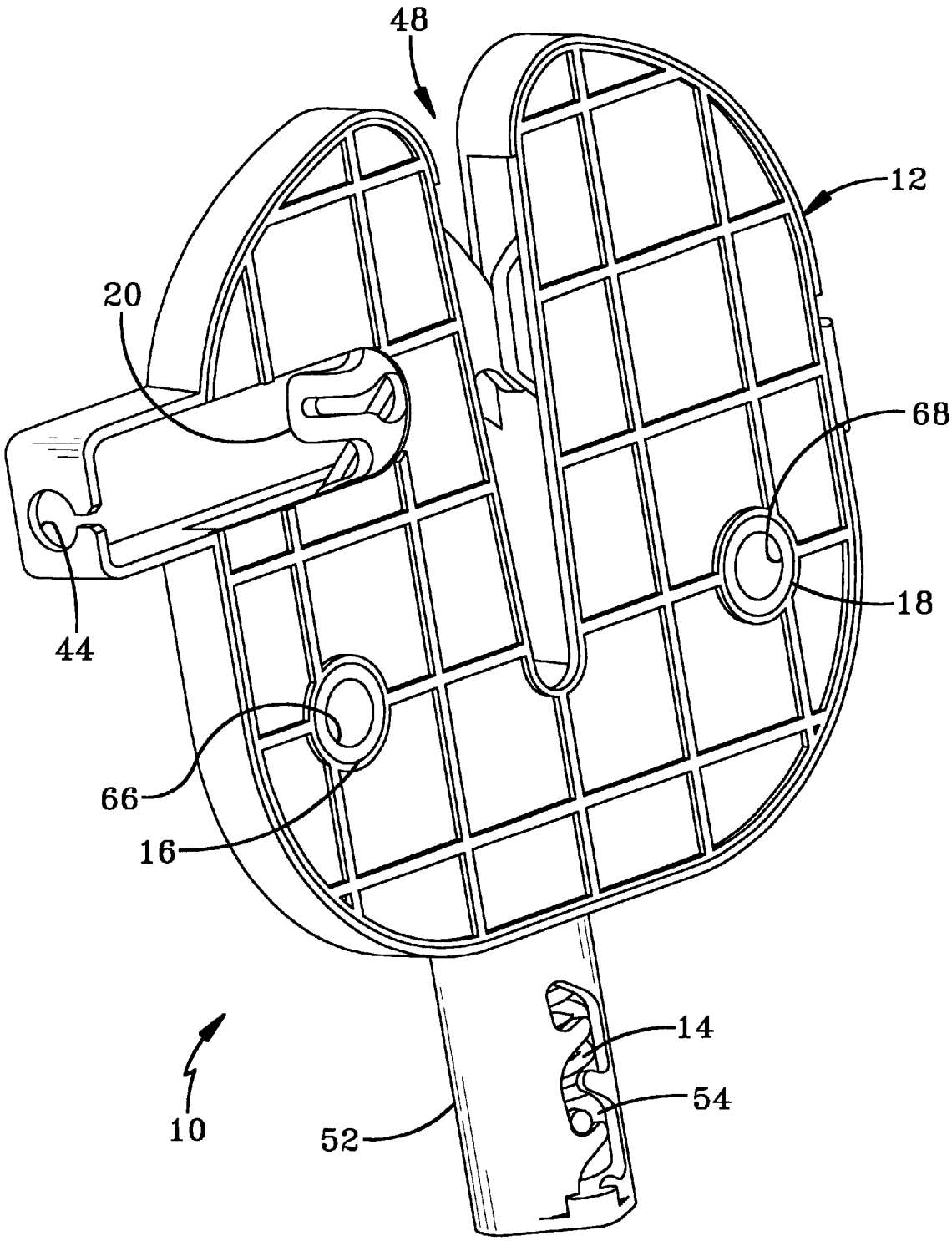
FIG. 4 is a perspective view of the adjustable hood latch mechanism of FIGS. 1 to 3 in a fully assembled state.

It should be understood that the appended drawings are not necessarily to scale, presenting a somewhat simplified representation of various preferred features illustrative of the basic principles of the invention. The specific design features of a latching mechanism as disclosed herein, including, for example, specific shapes of the pawl and ratchet will be determined in part by the particular intended application and use environment. Certain features of the illustrated embodiments have been enlarged or distorted relative to others to facilitate visualization and clear understanding. In particular, thin features may be thickened, for example, for clarity or illustration. All references to direction and position, unless otherwise indicated, refer to the orientation of the control pedal assembly illustrated in the drawings. In general, up or upward refers to an upward direction in the plane of the paper in FIGS. 7 to 11 and down or downward refers to a downward direction in the plane of the paper in FIGS. 7 to 11.

DETAILED DESCRIPTION OF CERTAIN PREFERRED EMBODIMENTS

It will be apparent to those skilled in the art, that is, to those who have knowledge or experience in this area of technology, that many uses and design variations are possible for the improved latching mechanism disclosed herein. The following detailed discussion of various alternative and preferred embodiments will illustrate the general principles of the invention with reference to a latching mechanism for use with a motor vehicle. Other embodiments suitable for other applications will be apparent to those skilled in the art given the benefit of this disclosure. The term "snap-fit connection" is used herein to mean a connection between at least two components wherein one of the components has an opening and the other component has a protrusion extending into the opening, and either the protrusion or the opening has a resiliently deformable portion to allow insertion of the protrusion into the opening as the deformable portion deforms upon entry but to deny undesired withdrawal of the protrusion from the opening after the deformable portion resiliently snaps back such that the two components are secured together.

Referring now to the drawings, FIGS. 1 to 7 illustrate a latching mechanism 10 for a hood of a motor vehicle, such as an automobile, according to the present invention. While the illustrated embodiments of the present invention are particularly adapted for use with an automobile, it is noted that the present invention can be utilized with any vehicle having a compartment with a closure including trucks, buses, vans, recreational vehicles, earth moving equipment and the like, off road vehicles such as dune buggies and the like, air borne vehicles, and water borne vehicles.

The latching mechanism 10 includes a housing 12, a striker spring 14, a pair of axles or support rivets 16, 18 for pivotally supporting internal components within the housing 12, a pawl 20, a ratchet 22, a hook 24, a paddle 26, and a pair of springs members 28, 30 for biasing the internal components 20, 22, 24, 26 about the rivets 16, 18.

The housing 12 includes first and second housing members 32, 34 which cooperate to from a hollow interior space for containing moving internal components 20, 22, 24, 26 of the latching mechanism 10. Because the housing members 32, 34 are not structural components as described in more detail hereinbelow, the housing members 32, 34 are preferably formed of a plastic or other suitable lightweight material. The housing members 32, 34 are preferably joined together without the use of mechanical fasteners such as by, for example, compression snap fittings, adhesives, heat sealing, or any other suitable joining means but can alternatively be joined by any suitable mechanical fasteners such as, for example, screws or rivets. The illustrated housing members 32, 34 are joined together with a snap-fit connection wherein the second housing member 34 is provided with a plurality of resiliently deflectable fingers 36 (best shown in FIGS. 1 and 6) and the first housing member 32 is provided with openings 38 for receiving the fingers 36 (best shown in FIGS. 6 and 7).

The housing members 32, 34 define a pair of horizontally extending passageways 40, 42 through the housing 12. The passageways 40, 42 are parallel and laterally spaced apart. The passageways 40, 42 are sized and shaped to support the rivets 16, 18 therein. The first housing member 32 defines means for securing a pawl actuator such as, for example, a cable actuator. The illustrated first housing member 32 defines an opening 44 adapted to secure the conduit of a Bowden or "push-pull" cable with a retainer 46.

The housing members 32, 34 also define a vertically extending terminal channel or groove 48 for receiving a striker 50 or other securing member secured to the closure of the vehicle compartment. The groove 48 is open at its upper end for receiving the striker 50 as the striker 50 moves in a generally downward direction. The first housing member 32 defines means for supporting the striker spring 14 adjacent the groove 48 so that as the striker 50 enters and downwardly travels in the groove 48, the striker 50 engages the striker spring 14 with a compressive force which compresses the striker spring 14. The compressive force is a function of the weight/velocity of the downwardly traveling compartment closure to which the striker 50 is attached. As the striker 50 downwardly moves in the groove 48, it also causes the pawl 20, the ratchet 22, and the hook 24 to pivot as described in more detail hereinafter.

Figure 5:
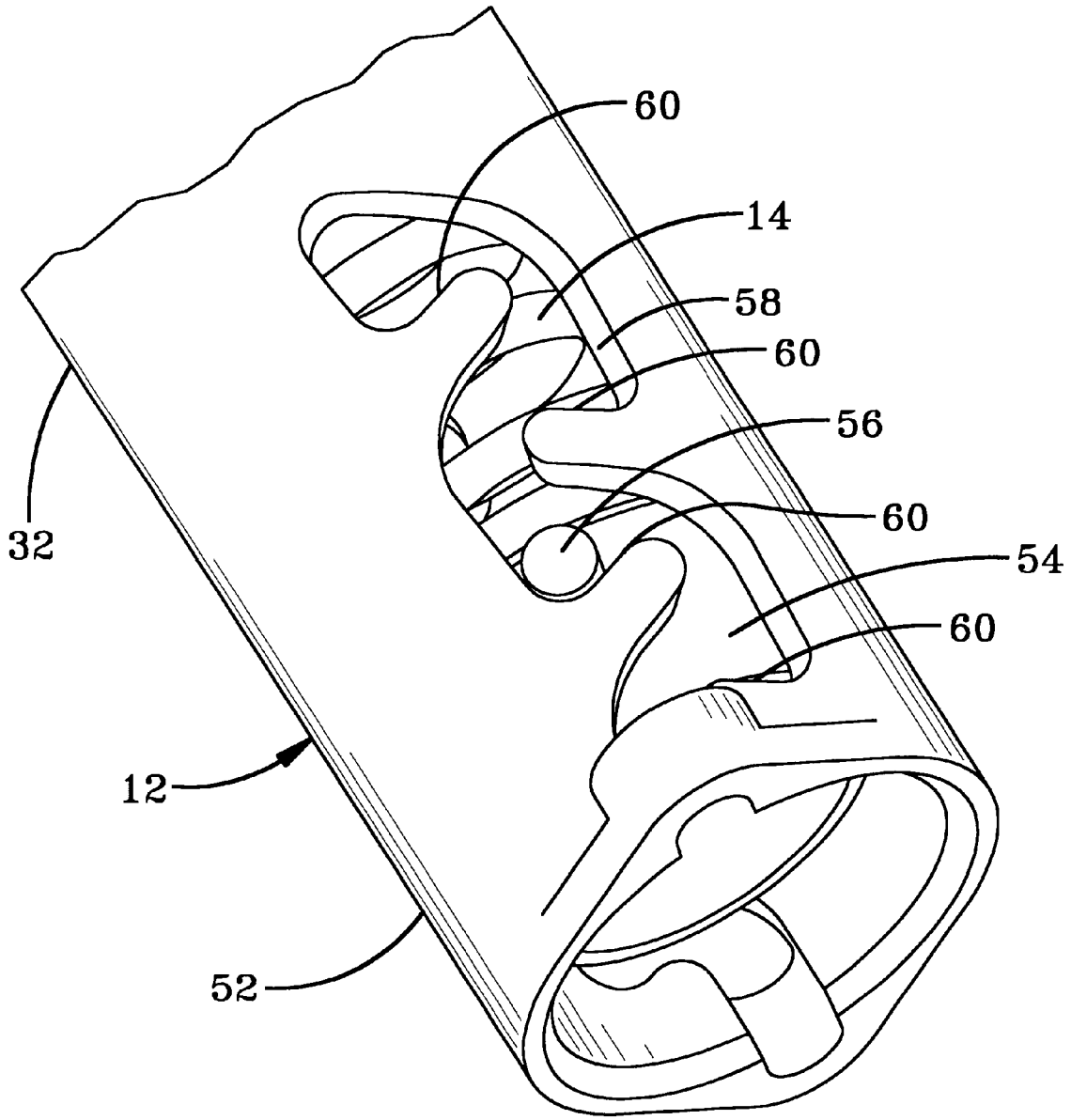
FIG. 5 is an enlarged perspective view of a portion of the adjustable hood latch mechanism FIG. 4.
Figure 6:
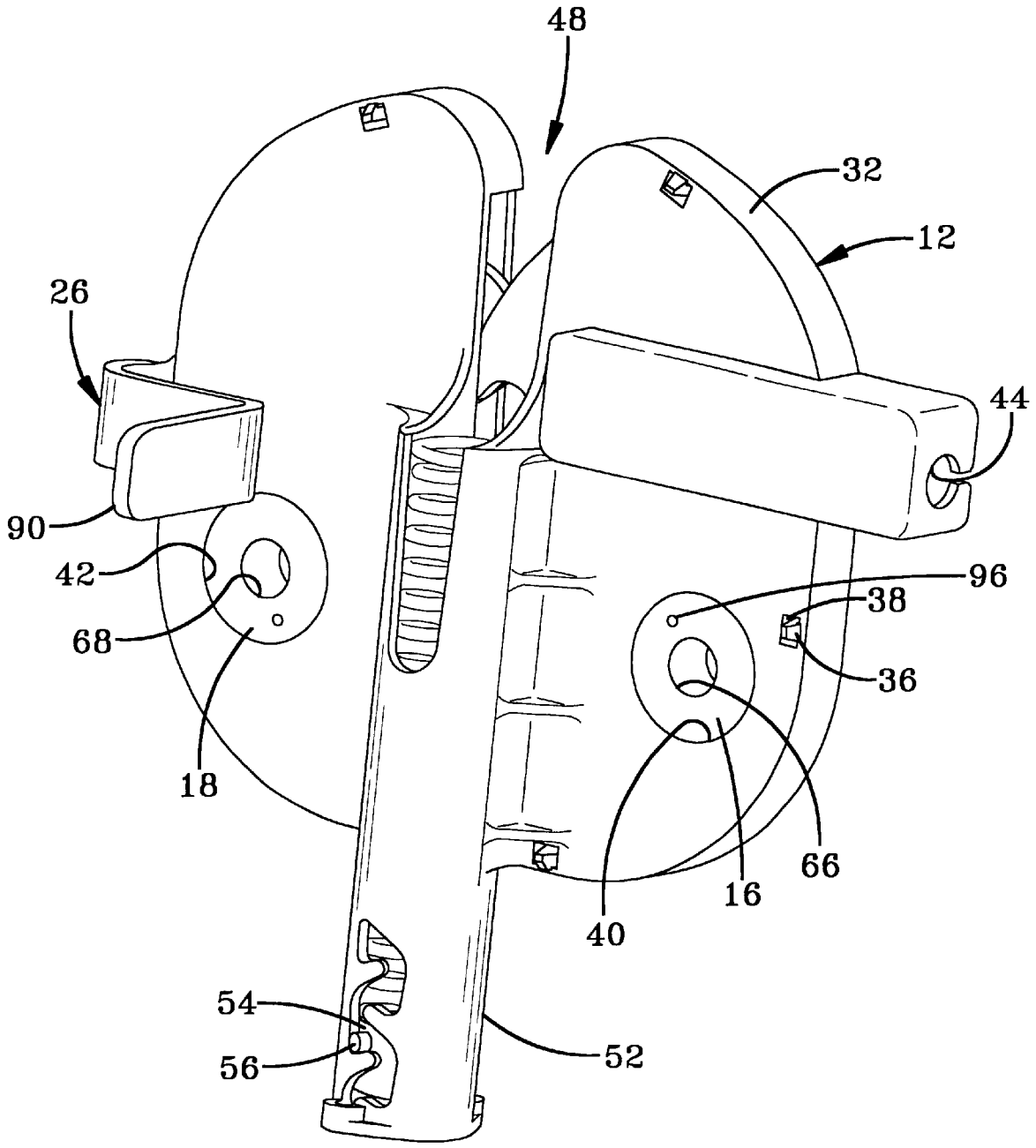
FIG. 6 is perspective view of the adjustable hood latch mechanism similar to FIG. 4 but showing the opposite side.

The illustrated first housing member 32 forms a vertically extending cylinder 52 for the striker spring 14 located adjacent the groove 48 and partially forming the groove 48. The illustrated striker spring 14 is helical-coil wire compression spring positioned within the cylinder 52. A retaining cap or plug 54 is provided at the lower end of the cylinder 52 to retain the striker spring 14 within the cylinder 52. Preferably, the retaining plug 54 is selectively adjustable along the axial length of the cylinder 52 so that the vertical position of the striker spring 14, and therefore the force applied to the striker 50, is adjustable. As best shown in FIG. 5, the illustrated retaining plug 54 is provided with a pair of oppositely extending pins 56 which cooperate with a pair of opposed grooves 58 formed in the wall of the cylinder 52. The pins 56 cooperate with the grooves 58 in a bayonet-connector-type manner. The grooves 58 form a plurality of axially spaced apart abutments 60 which position the retaining plug 54 at a plurality of predefined axial positions along the cylinder 52. The illustrated grooves 58 each define four abutments 60 but a greater or lesser number can be utilized within the scope of the present invention. It is noted that the retaining plug 54 can alternatively be axially adjustable along the cylinder 52 in other suitable manners. It should be appreciated that changing the axial position of the retaining plug 54 changes the spring force of the striker spring 14 acting on the striker 50.

The rivets 16, 18 are sized and shaped to support the internal components 20, 22, 24, 26 and to form parallel axes of rotation 62, 64 for the pivoting internal components 20, 22, 24, 26. The rivets 16, 18 are preferably hollow rivets which define passageways 66, 68 for fasteners to attach the latching mechanism 10 to the vehicle. The rivets 16, 18 are preferably inserted into or affixed to the first housing member 32. Fastening means for attaching the latching mechanism 10 to a vehicle can be any suitable means such as, for example, at least one conventional bolt, carriage bolt, or other suitable fastener known in this art. Preferably, two bolts secure the latching mechanism 10 to the vehicle by extending through the passageways 66, 68 formed by the rivets 16, 18.

The pawl 20 and the ratchet 22 are pivotally mounted on opposite ones of the rivets 16, 18 so that they are generally coplanar. The pawl 20 can be of any suitable configuration so long as the pawl 20 defines a notch or mating surface 70 for receiving a protuberance 72 defined by the periphery of the ratchet 22 and cooperating with the notch 70 to secure the ratchet 22 in a locked position as described in more detail hereinbelow. The ratchet 22 defines the protuberance 72 for cooperating with the pawl 20 and a notch or pocket 74 for receiving the striker 50 and cooperating with the striker 50 to secure the striker 50 within the latching mechanism 10 when the ratchet 22 is in the locked position. The pawl notch 70 functions to maintain the ratchet 22 in a locked position and the ratchet pocket 74 functions to maintain the striker 50 within the latching, mechanism 10.

The pawl 20 is also adapted for cooperation with the pawl actuator. The illustrated pawl 20 defines an opening 76 adapted to secure the core wire of a Bowden or "push-pull" cable. With the pawl actuator attached to the pawl 20, operation of the pawl actuator pivots the pawl 20 about the first rivet 16 to disengage the ratchet protuberance 72 from the pawl notch 70 so that the ratchet 22 may pivot about the second rivet 18 and release the striker 50 from the ratchet pocket 74. The striker 50 is propelled upward by the compressed striker spring 14, releasing the compressive force stored in the striker spring 14 when the striker 50 entered the groove 48. It should be appreciated that while the pawl 20 is typically actuated manually by conventional push or pull cable systems the pawl 20 can be alternatively actuated by electronic or magnetic means. The location of the control device of the pawl actuator can be at any desired location of the vehicle, e.g., underneath the dash, within a door opening, among other locations.

The hook 24 and the paddle 26 are pivotally mounted on opposite ones of the rivets 16, 18 so that they are generally coplanar. In the illustrated embodiment, the hook 24 is mounted on the first rivet 16 with the pawl 20 and the paddle 26 is mounted on the second rivet 18 with the ratchet 22. The hook 24 is sized and shaped to extend adjacent both the pawl 20 and the ratchet 22 and defines first and second slots 78, 80. The first slot 78 receives a pin 82 perpendicularly extending from the pawl 20 and the second slot 80 receives a pin 84 perpendicularly extending from the ratchet 22. The slots 78, 80 are sized and shaped to control movement of the hook 24 relative to the pawl 20 and the ratchet 22. The pins and slots 78, 80, 82, 84 transfer force and motion between the pawl 20, the ratchet 22, the hook 24, and the paddle 26 as described in more detail hereinafter. The hook 24 also defines a notch or catch 86 for receiving the striker 50 and securing the striker 50 within the latching mechanism 10 as a safety or secondary latching means when the ratchet 22 is released from its locked position.

The paddle 26 defines a protrusion 88 which is sized and shaped to selectively engage the hook 24 to pivot the hook 24 in response to pivotal movement of the paddle 26 as described in more detail hereinafter. The paddle 26 includes a handle portion 90 which extends through an opening 92 in the housing 12 so that an operator can pivot the paddle 26 about the second rivet 18 by selectively applying a manual force on the handle portion 90. As the paddle 26 pivots, the protrusion 88 engages the periphery of the hook 26 in a cam like manner to pivot the hook 26 and release the striker 50 from the hook catch 86. It is noted that the paddle 26 can additionally or alternatively have a pin which contacts a peripheral portion of the ratchet 22 in a cam-fashion to pivot the ratchet 22.

The first and second spring members 28, 30 are adapted to bias the internal components 20, 22, 24, 26 in a desired manner. The illustrated spring members 28, 30 are wire torsion springs, each having two legs or wire ends which provide force in opposite directions. The first spring member 28 is mounted about the first rivet 16 and has one end connected to the pawl 20 and the other end connected to the first rivet 16. The illustrated first spring member 28 is connected to the pawl 20 by extending into an opening 94 (best seen in FIG. 1) formed in the pawl 20 and is connected to the first rivet 16 by extending into an opening 96 (best seen in FIG. 6) formed in the first rivet 16. The first spring member 28 biases the pawl 20 in a clockwise direction (as viewed in FIG. 7) about the first rivet 16. The first spring member 28 provides a common biasing force on the pawl 20 and the hook 24 when the pawl pin 82 engages an end of the hook first slot 78. The second spring member 30 is mounted about the second rivet 18 and has one end connected to the ratchet 22 and the other end connected to the paddle 26. The illustrated second spring member 30 is connected to the ratchet 22 by extending into an opening 98 (best seen in FIG. 1) formed in the ratchet 22 and is connected to the paddle 26 by extending into an opening 100 (best seen in FIG. 1) formed in the paddle 26. The second spring member 30 biases the ratchet 22 in a clockwise direction (as viewed in FIG. 7) about the second rivet 18 and biases the paddle 26 in a counterclockwise direction (as viewed in FIG. 7) about the second rivet 18. The second spring member 30 provides a common biasing force on the ratchet 22 and the hook 24 when the ratchet pin 84 engages an end of the hook second slot 80. It is noted that each of the spring members 28, 30 bias the hook 24 when the hook 24 engages the pawl 20 and/or the ratchet 22.

Figure 7:
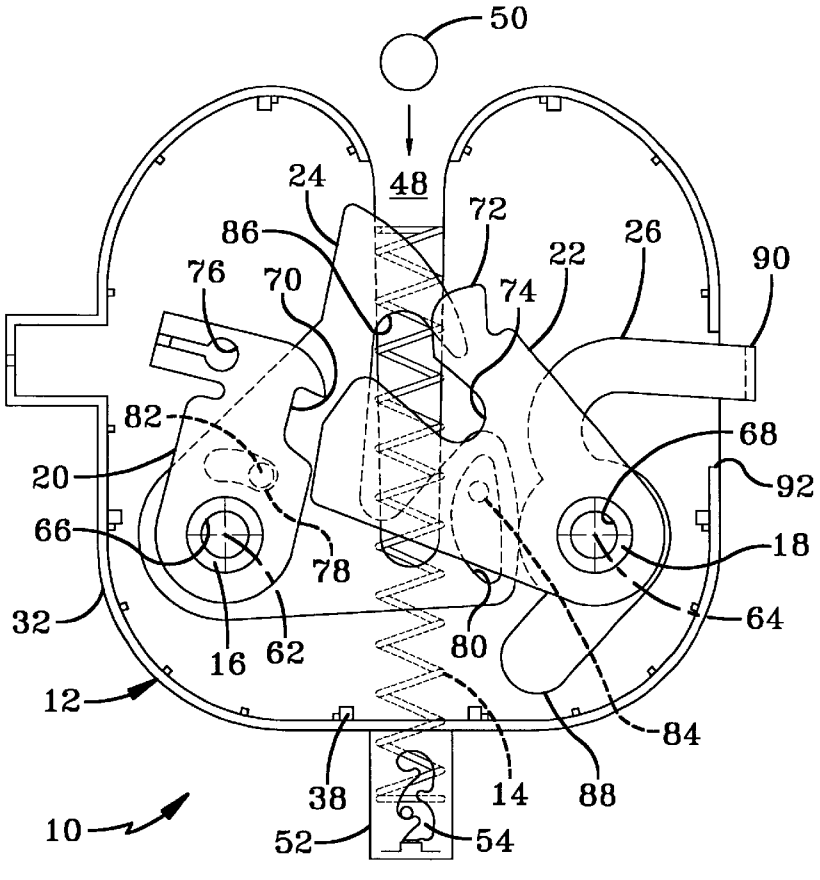
FIG. 7 is an elevational view of the adjustable hood latch mechanism of FIGS. 1 to 6 in an unlatched position.

FIGS. 7–10 illustrate operation of the latching mechanism 10. FIG. 7 illustrates the latching mechanism 10 in an unlatched position wherein the striker 50 is shown to be travelling downward toward the groove 48. As striker 50 enters and travels into the groove 48, the striker 50 engages the upper end of the striker spring 14 and compresses the striker spring 14. The striker 50 also engages the upper periphery of the hook 24 which pivots the hook 24 in a counterclockwise direction (as viewed in FIG. 7) about the first rivet 16 in a cam like manner. After the striker 50 passes the upper portion of the hook 24, it engages the pocket 74 of the ratchet 22 and pivots the ratchet 22 in counterclockwise direction (as viewed in FIG. 7) about the second rivet 18 to a position which retains the striker 50 within the latching mechanism 10. This movement of the ratchet 22 enables the first spring member 16 to rotate the pawl 20 in a clockwise direction (as viewed in FIG. 7) about the first rivet 16 until the notch 70 of the pawl 20 engages the ratchet protuberance 72 so that the pawl 20 retains the ratchet 22 in the locked or latched position.

Figure 8:
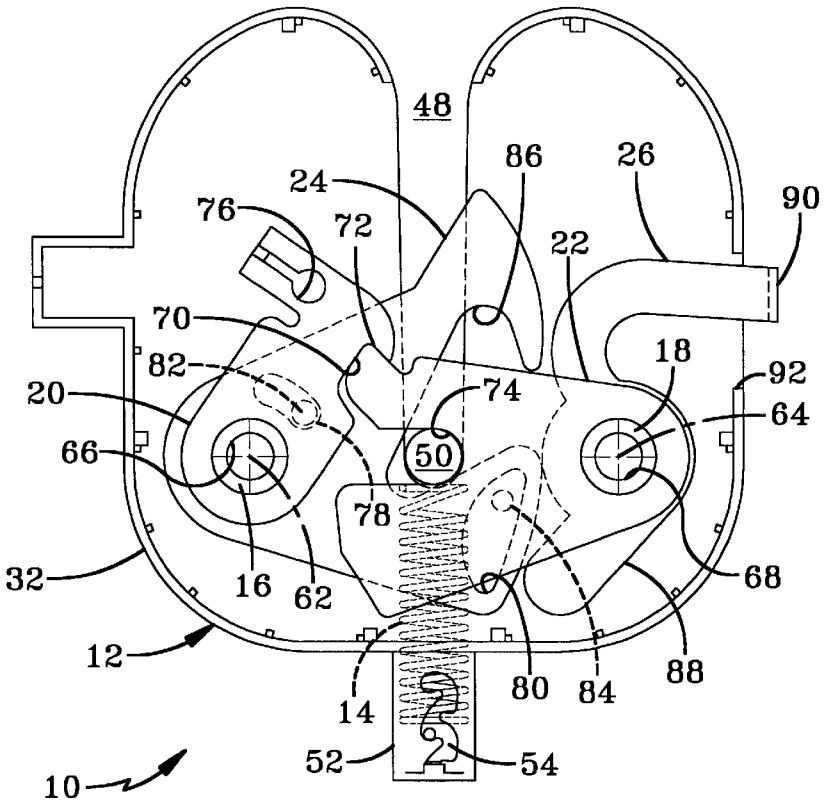
FIG. 8 is an elevational view of the adjustable hood latch mechanism of FIG. 7 in a latched position.

FIG. 8 illustrates the latching mechanism 10 in the latched position. The striker 50 is biased upward in the groove 48 by the compressed striker spring 14. The striker 50 is retained in position by the pocket 74 of the ratchet 22. The ratchet 22 is biased in a clockwise direction (as viewed in FIG. 8) about the second rivet 18 by the compressed striker spring 14 and the second spring member 30. The ratchet 22 is retained in position by the notch 70 of the pawl 20. The pawl 20 is biased in the clockwise direction (as viewed in FIG. 8) about the first rivet 16 by the first spring member 28. The paddle 26 is biased in a counterclockwise direction (as viewed in FIG. 8) about the second rivet 18 by the second spring member 30. The ratchet 22 is released from the previously described locked position by overcoming the bias of the first spring member 28 and pivoting the pawl 20 away from the ratchet 22.

Figure 9:
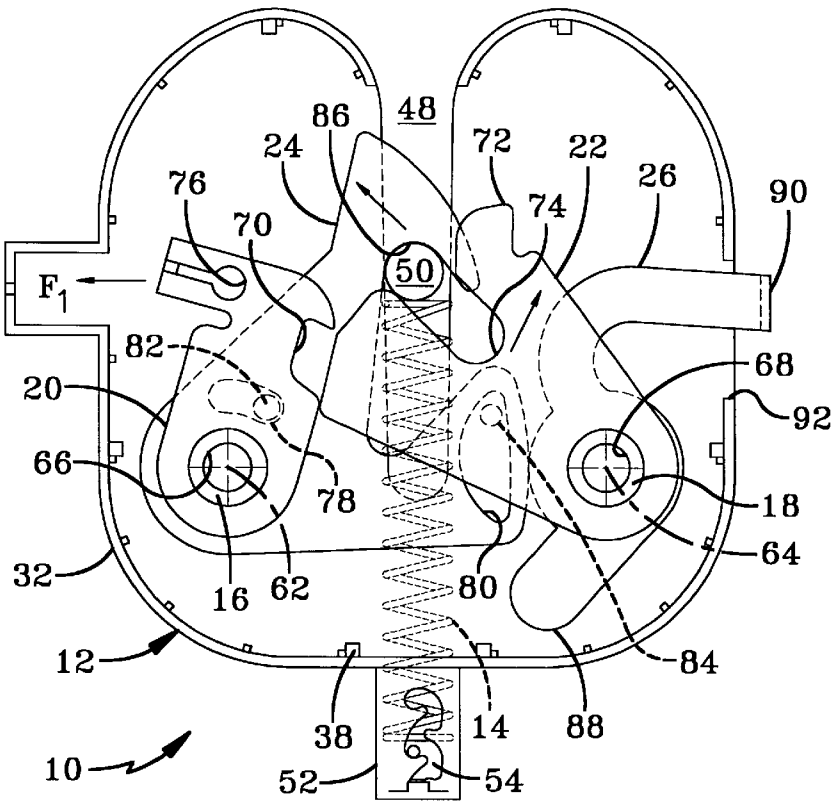
FIG. 9 is an elevational view of the adjustable hood latch mechanism of FIGS. 7 and 8 in a pop-up position.

FIG. 9 illustrates the latching mechanism 10 in a partially released or pop-up position. This partially released position is obtained when the operator selectively operates the pawl actuator when it desired to open the closure of the vehicle compartment. When the operator operates the pawl actuator, the pawl 20 pivots in a counterclockwise direction about the first rivet 16 until pawl notch 70 is clear of the ratchet protuberance 72. In the illustrated embodiment, the core wire of the push-pull cable pulls the pawl 20 with force $F_1$. When the ratchet protuberance 72 is free of the pawl notch 70, the upward force of the striker spring 14 rotates the ratchet 22 in a clockwise direction (as viewed in FIG. 9) and moves the striker 50 upward from the ratchet's pocket 74 until it contacts the catch 86 of the hook 24 which blocks the striker 50 from completely exiting the latching mechanism 10. As a result, the striker 50 is partially released and the closure of the vehicle compartment is ajar.

The striker 50 is biased upward in the groove 48 by the compressed striker spring 14. The amount of spring force supplied by the striker spring 14 is dependent upon the position of the retaining plug 54 in the cylinder 52. The striker 50 is retained in position by engagement with the hook 24. The ratchet 22 is biased in a clockwise direction (as viewed in FIG. 9) about the second rivet 18 by the second spring member 30. The ratchet 22 is retained in position by engagement with the striker 50. The pawl 20 is biased in the clockwise direction (as viewed in FIG. 9) about the first rivet 16 by the first spring member 28. The pawl 20 is retained in position by engagement with the ratchet 22. The paddle 26 is biased in a counterclockwise direction (as viewed in FIG. 9) about the second rivet 18 by the second spring member 30.

Figure 10:
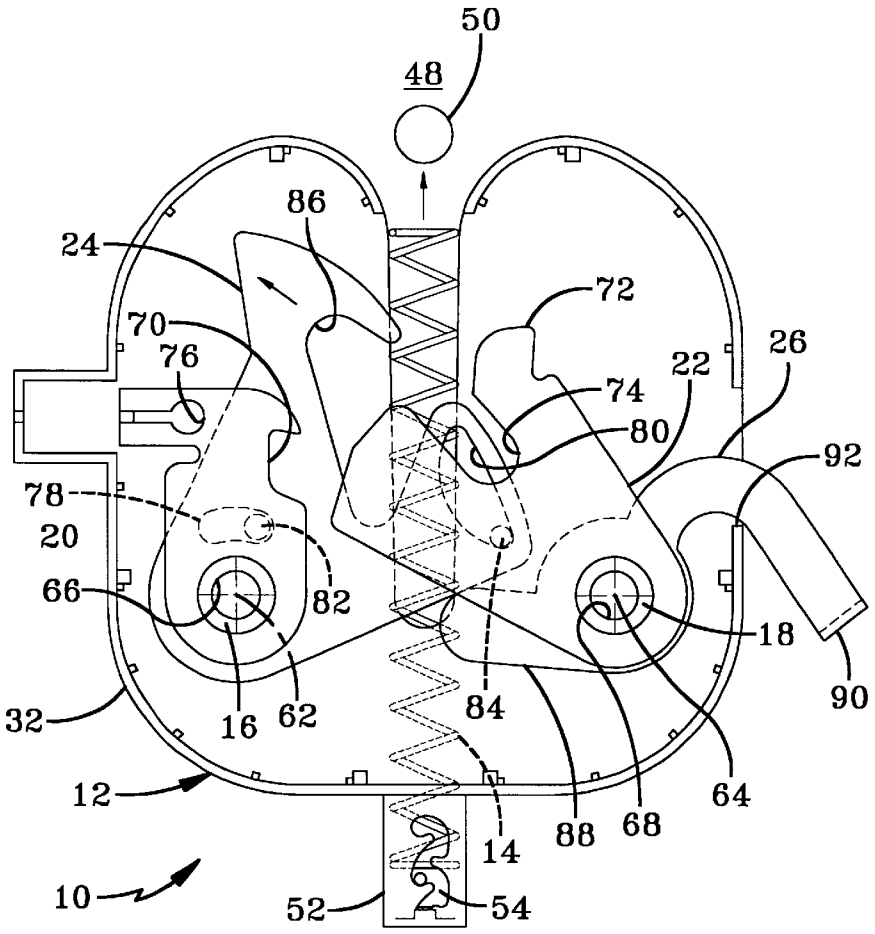
FIG. 10 is an elevational view of the adjustable hood latch mechanism of FIGS. 7–9 in a secondary release position.

FIG. 10 illustrates the latching mechanism 10 in a fully released position. The operator selectively applies a rotational force $F_2$ onto the paddle 26 that pivots the paddle 26 in a clockwise direction (as viewed in FIG. 10) about the second rivet 18. As the paddle 26 pivots, the paddle protrusion 88 engages the periphery of the hook 24 that in turn applies a force onto the hook 24. The force on the hook 24 causes the hook 24 and to rotate in a clockwise direction (as viewed in FIG. 10) about the first rivet 16 and away from the striker 50. When the hook 24 rotates free of the striker 50, the remaining compressive force in the striker spring 14 forces the striker 50 out of the groove 48 and the latching mechanism 10. When the operator releases the paddle 26, the first and second spring members 28, 30 return the pawl 20, the ratchet 22, the hook 24, and the paddle 26 to unlatched position as shown in FIG. 7. The above described cycle of latching, pop-up release, and fill release is selectively repeated as the operator desires closure of and access to the vehicle compartment.

Figure 11:
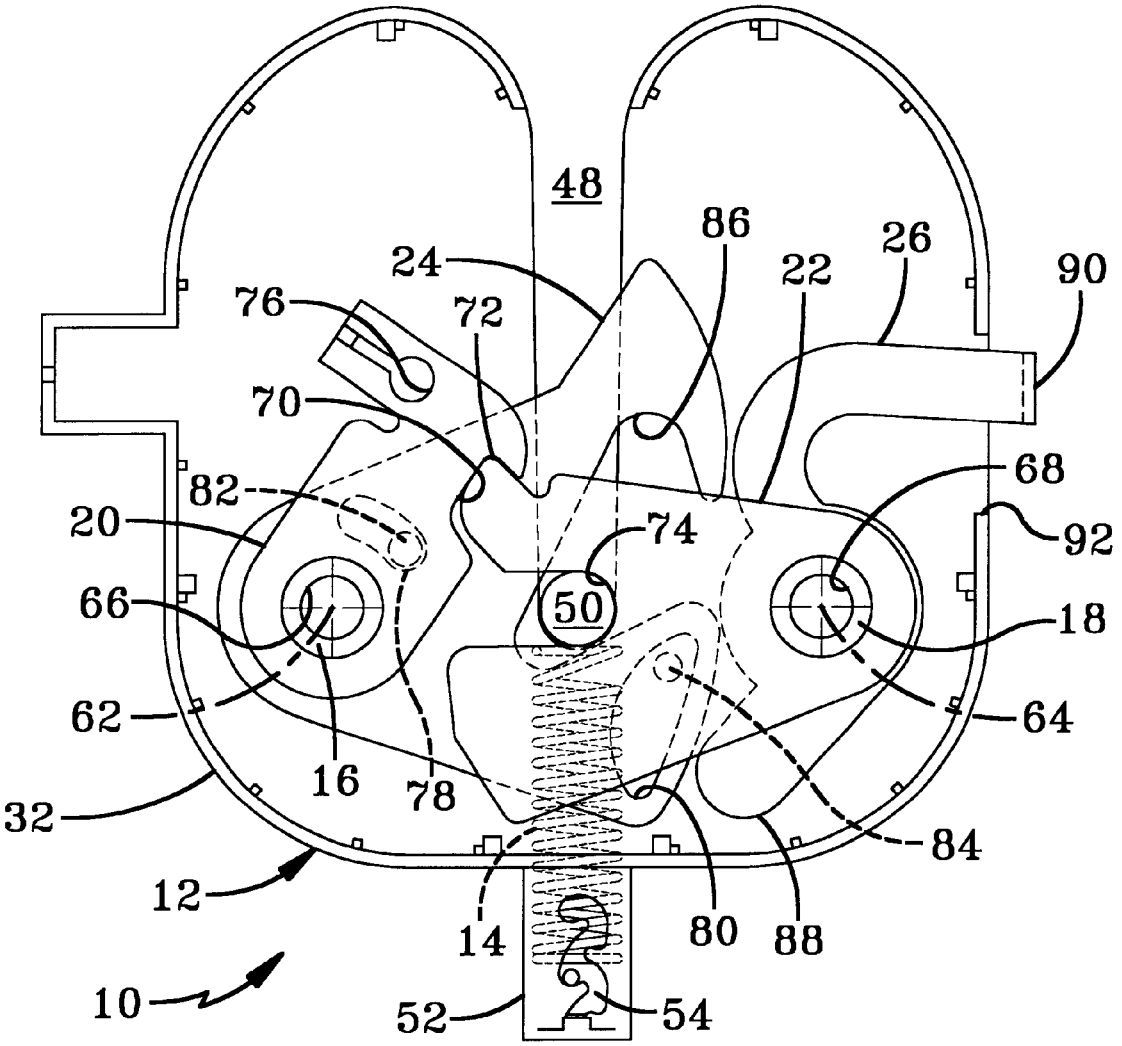
FIG. 11 is an elevational view of the adjustable hood latch mechanism of FIGS. 7–10 in an over-slam position.

FIG. 11 illustrates the latching mechanism in an "over-slam" position. When moving from the unlatched position (FIG. 7) to the latched position (FIG. 8), the striker 50 is moving downwardly into the groove 48 as described above. This downward movement may be with more force than needed to move to the latching position. The additional or "over slam" force causes the striker 50 to travel downwardly until the ratchet protuberance 72 engages the bottom side of the pawl notch 70 and the force is transmitted to the vehicle structure through the rivets 16, 18 and fasteners. The pawl 20 provides an internal stop which absorbs the full impact of the over slam after only a slight movement of the ratchet 22. Because the force is not transmitted through the housing 12, the housing 12 can be constructed of a lighter weight material such as a plastic. Once the impact is absorbed, the striker 50 begins to travel back upwardly due to the force of compressed striker spring 14. Notwithstanding the slight upward movement, the striker 50 is retained in the latched position as described herein above. Preferably, the pawl notch 70 permits an "over slam" rotation of the ratchet 22 of about 2 degrees.

While the latching mechanism 10 can be fabricated from any suitable material and in accordance with conventional methods, examples of such materials comprise thermoplastics such as nylon, die castable metals such as magnesium. If desired, the materials can be reinforced with filler materials such as glass or mineral fibers, among other materials conventionally used for reinforcing thermoplastics and metals. It should be appreciated that key components of the latching mechanism 10 can be fabricated by using conventional injection molding techniques, e.g., glass/mineral reinforced nylon. The ability to utilize injection moldable materials obviates manufacturing steps associated with metal fabrication such as stamping, heat treating, staking, welding, riveting and defects associated with such steps. By using injection moldable materials, the weight of the latching mechanism 10 can be reduced.

It should be appreciated from the above description that the latching mechanism 10 of the present invention can be locating in a wide range of locations. For example, the latching mechanism 10 can be employed with forward or rearward opening hoods. It should be noted, however, that normally the latching mechanism 10 is positioned perpendicular to the vehicular compartment. It should also be appreciated that the latching mechanism 10 can include an electronic sensor or switch. Such a switch can signal whether or not the vehicle hood is open or partially released (in the "pop-up" position). The position of the hood can be reported to the vehicle operator as well as incorporated into safety and theft deterrent systems.

From the foregoing description, it is apparent that the latching mechanism 10 of the present invention solves problems associated with conventional latching mechanisms by having relatively few internal moving components. Additionally, the latching mechanism 10 can be fabricated from moldable materials, e.g., injection molded mineral reinforced nylon, thereby obviating stamping and staking manufacturing steps. Furthermore, the orientation of the latching mechanism 10 relative to the striker 50 as well as the operation of the latching mechanism 10 provide greater design flexibility in vehicular components that are associated with the latching mechanism 10. The latching mechanism 10 changes the distribution of forces within the latch, hood and striker thereby obviating a crown or ridge typically employed for reinforcing the hood. This change in force distribution also reduces rattles by having a spring force directly acting on the striker 50, permits the use corrosion resistant materials by transmitting forces directly to the attachment fasteners, implements a standardized hood latch for a wide range of vehicles by having an adjustable striker spring force, provides over slam protection by having an internal stop which absorbs the fill impact, and other desirable results.

The latching mechanism can be utilized on a wide range of hood size, weights and dimensions. The latch responds to a given hood and applies a release force (so-called "pop-up) that is appropriate for the hood. The release force is obtained by the striker spring that is compressed by the hood striker upon entering the latching mechanism.

From the foregoing disclosure and detailed description of certain preferred embodiments, it will be apparent that various modifications, additions and other alternative embodiments are possible without departing from the true scope and spirit of the present invention. For example, it will be apparent to those skilled in the art, given the benefit of the present disclosure, that the adjustment means of the striker spring 14 can have many different forms. The embodiments discussed were chosen and described to provide the best illustration of the principles of the present invention and its practical application to thereby enable one of ordinary skill in the art to utilize the invention in various embodiments and with various modifications as are suited to the particular use contemplated. All such modifications and variations are within the scope of the present invention as determined by the appended claims when interpreted in accordance with the benefit to which they are fairly, legally, and equitably entitled.

What is claimed is:

1. A latching mechanism for selectively retaining a closure having a striker, the latching mechanism comprising, in combination:

a housing forming a vertically extending groove for receiving the striker;

first and second axles located on opposite sides of the groove;

a striker spring located at the groove;

wherein the striker spring provides a force in a vertical direction to bias the striker out of the groove;

a pawl pivotable about the first axle and defining a notch; and a ratchet pivotable about the second axle and defining a protrusion adapted to cooperate with the notch of the pawl to selectively retain the ratchet in a locked position, the ratchet also defining a pocket for receiving the striker and retaining the striker in the groove when the ratchet is in the locked position.

2. The latching mechanism according to claim 1, wherein the axles define axially extending passageways therethrough which are, sized and shaped for receiving fasteners to attach the latching mechanism.

3. The latching mechanism according to claim 1, wherein the axles are substantially parallel and spaced apart on opposite sides of the groove.

4. The latching mechanism according to claim 1, wherein the housing is formed of a plastic material.

5. The latching mechanism according to claim 1, wherein the housing is adapted to substantially enclose the pawl and the ratchet, the housing including first and second housing members which cooperate to form a hollow interior space, and the pawl and the ratchet are located within the hollow interior space and between the first and second housing members.

6. The latching mechanism according to claim 1, wherein the pawl is adapted for connection of an actuator for pivoting the pawl about the first axle.

7. The latching mechanism according to claim 1, wherein the striker spring at least partially extends into the groove.

8. The latching mechanism according to claim 1, further comprising a hook pivotal about the first axle and defining a catch for receiving the striker to retain the striker in the groove.

9. The latching mechanism according to claim 8, wherein the hook is operatively connected to both the pawl and the ratchet to control movement of the hook.

10. A latching mechanism for selectively retaining a closure having a striker, the latching mechanism comprising, in combination:

a housing forming a vertically extending groove for receiving the striker;

first and second axles located on opposite sides of the groove;

a striker spring located at the groove;

a pawl pivotable about the first axle and defining a notch;

a ratchet pivotable about the second axle and defining a protrusion adapted to cooperate with the notch of the pawl to selectively retain the ratchet in a locked position, the ratchet also defining a pocket for receiving the striker and retaining the striker in the groove when the ratchet is in the locked position; and wherein the striker spring is positioned at the groove to be directly engaged by the striker when the ratchet is in the locked position.

11. A latching mechanism for selectively retaining a closure having a striker, the latching mechanism comprising, in combination:

a housing forming a vertically extending groove for receiving the striker;

first and second axles located on opposite sides of the groove;

a striker bring located at the groove;

a pawl pivotable about the first axle and defining a notch;

a ratchet pivotable about the second axle and defining a protrusion adapted to cooperate with the notch of the pawl to selectively retain the ratchet in a locked position, the ratchet also defining a pocket for receiving the striker and retaining the striker in the groove when the ratchet is in the locked position;

a hook pivotal about the first axle and defining a catch for receiving the striker to retain the striker in the groove; and wherein the hook is operatively connected to both the pawl and the ratchet with pin and slot connections.

12. A latching mechanism for selectively retaining a closure having a striker, the latching mechanism comprising, in combination:

a housing forming a vertically extending groove for receiving the striker;

first and second axles located on opposite sides of the groove;

a striker spring located at the groove;

a pawl pivotable about the first axle and defining a notch;

a ratchet pivotable about the second axle and defining a protrusion adapted to cooperate with the notch of the pawl to selectively retain the ratchet in a locked position, the ratchet also defining a pocket for receiving the striker and retaining the striker in the groove when the ratchet is in the locked position;

a hook pivotal about the first axle and defining a catch for receiving the striker to retain the striker in the groove; and a paddle pivotable about the second axle for manually pivoting the hook.

13. A latching mechanism for selectively retaining a closure having a striker, the latching mechanism comprising, in combination:

a housing forming a vertically extending groove for receiving the striker;

first and second axles located on opposite sides of the groove;

a striker spring located at the groove;

a pawl pivotable about the first axle and defining a notch;

a ratchet pivotable about the second axle and defining a protrusion adapted to cooperate with the notch of the pawl to selectively retain the ratchet in a locked position, the ratchet also defining a pocket for receiving the striker and retaining the striker in the groove when the ratchet is in the locked position; and means for adjusting the position of the striker spring relative to the groove to adjust the spring force.

14. The latching mechanism according to claim 13, wherein the housing forms a cylinder for supporting the striker spring and the adjusting means includes a retaining plug selectively adjustable along of the cylinder.

15. The latching mechanism according to claim 14, wherein the retaining plug has a pair of opposed pins and the cylinder has a pair of grooves for cooperating with the pins and retaining the retaining plug at selected positions along the cylinder.

16. A latching mechanism for selectively retaining a closure having a striker, the latching mechanism comprising, in combination:

a housing forming a vertically extending groove for receiving the striker;

first and second axles located on opposite sides of the groove;

a striker spring located at the groove;

a pawl pivotable about the first axle and defining a notch;

a ratchet pivotable about the second axle and defining a protrusion adapted to cooperate with the notch of the pawl to selectively retain the ratchet in a locked position, the ratchet also defining a pocket for receiving the striker and retaining the striker in the groove when the ratchet is in the locked position; and a stop supported by at least one of the axles and adapted to limit rotation of the ratchet upon downward movement of the striker in the groove.

17. The latching mechanism according to claim 16, wherein the notch of the pawl is adapted to limit pivotal movement of the ratchet in either direction.

18. The latching mechanism according to claim 17, wherein the notch of the pawl has a pair of generally opposed abutments.

19. The latching mechanism according to claim 17, wherein the pocket of the ratchet has opposed abutments limiting upward and downward movement of the striker when the ratchet is in the locked position.

* * * * *